US010607538B2

(12) United States Patent
Zhu et al.

(10) Patent No.: US 10,607,538 B2
(45) Date of Patent: Mar. 31, 2020

(54) PIXEL CIRCUIT, PIXEL, AMOLED DISPLAY DEVICE COMPRISING SAME AND DRIVING METHOD THEREOF

(71) Applicants: KUNSHAN NEW FLAT PANEL DISPLAY TECHNOLOGY CENTER CO., LTD., KunShan, Jiangsu (CN); KUNSHAN GO-VISIONOX OPTO-ELECTRONICS CO., LTD., KunShan, Jiangsu (CN)

(72) Inventors: Hui Zhu, Kunshan (CN); Siming Hu, Kunshan (CN); Xiuqi Huang, Kunshan (CN)

(73) Assignees: KUNSHAN NEW FLAT PANEL DISPLAY TECHNOLOGY CENTER CO., LTD., Kunshan (CN); KUNSHAN GO-VISIONOX OPTO-ELECTRONICS CO., LTD., Kunshan (CN)

( * ) Notice: Subject to any disclaimer, the term of this patent is extended or adjusted under 35 U.S.C. 154(b) by 0 days.

(21) Appl. No.: 15/109,420

(22) PCT Filed: Dec. 29, 2014

(86) PCT No.: PCT/CN2014/095331
§ 371 (c)(1),
(2) Date: Jun. 30, 2016

(87) PCT Pub. No.: WO2015/101255
PCT Pub. Date: Jul. 9, 2015

(65) Prior Publication Data

US 2016/0358547 A1 Dec. 8, 2016

(30) Foreign Application Priority Data

Dec. 31, 2013 (CN) ..... 2013 1 0747565

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/043* (2013.01);
(Continued)

(58) Field of Classification Search
CPC .. G09G 3/3233; G09G 3/3225; G09G 3/3258; G09G 3/3208; G09G 3/006; G09G 3/20; G09G 3/3241; H01L 27/3276
(Continued)

(56) References Cited

U.S. PATENT DOCUMENTS 7,180,486 B2 2/2007 Jeong
7,355,574 B1 * 4/2008 Leon ..... G09G 3/3233 345/101
(Continued)

FOREIGN PATENT DOCUMENTS

CN 1664901 A 9/2005
CN 1664910 A 9/2005
(Continued)

*Primary Examiner* — Fred Tzeng
(74) *Attorney, Agent, or Firm* — Maschoff Brennan

(57) ABSTRACT

A pixel circuit, a pixel, and an AMOLED (Active Matrix Organic Light-Emitting Diode) display device comprising the pixel and a driving method thereof. The pixel circuit comprises a power supply circuit, a basic circuit and a compensation circuit, which are sequentially connected. The power supply circuit is connected to a first power supply to supply power to the basis circuit. The compensation circuit is connected to second and third power supplies, respectively, for providing difference values compensating for a voltage and current of an OLED (Organic Light-Emitting Diode). The pixel comprises an OLED and the pixel circuit. The AMOLED display device comprises the pixel circuit. By compensating for a difference between threshold and
(Continued)

power supply voltages of a transistor, the response characteristics of the AMOLED may be improved to generate light of a same brightness, thereby meeting requirements on image uniformity and consistency of an AMOLED.

11 Claims, 4 Drawing Sheets

(52) U.S. Cl.
CPC ..... *G09G 2300/0814* (2013.01); *G09G 2300/0819* (2013.01); *G09G 2300/0842* (2013.01); *G09G 2300/0866* (2013.01); *G09G 2310/061* (2013.01); *G09G 2320/0233* (2013.01); *G09G 2320/045* (2013.01)

(58) Field of Classification Search
USPC ..... 345/215
See application file for complete search history.

(56) References Cited

U.S. PATENT DOCUMENTS

| | | | | |
|---|---|---|---|---|
| 8,294,737 | B2 | 10/2012 | Tanikame et al. | |
| 9,311,852 | B2 | 4/2016 | Wang | |
| 9,424,777 | B2 * | 8/2016 | Kong | G09G 3/3258 |
| 9,666,112 | B2 * | 5/2017 | Kim | G09G 3/006 |
| 9,704,438 | B2 * | 7/2017 | Lee | G09G 3/3233 |
| 2004/0174349 | A1 | 9/2004 | Libsch et al. | |
| 2006/0012310 | A1 | 1/2006 | Chen | |
| 2006/0055336 | A1 * | 3/2006 | Jeong | G09G 3/3233 315/169.3 |
| 2006/0108937 | A1 * | 5/2006 | Kim | G09G 3/3233 315/169.3 |
| 2006/0221007 | A1 * | 10/2006 | Kim | G09G 3/3225 345/76 |
| 2007/0126663 | A1 * | 6/2007 | Kim | G09G 3/3241 345/76 |
| 2008/0001854 | A1 * | 1/2008 | Hamer | G09G 3/3233 345/76 |
| 2008/0001855 | A1 * | 1/2008 | Hamer | G09G 3/3233 345/76 |
| 2009/0109147 | A1 * | 4/2009 | Park | G09G 3/20 345/76 |
| 2009/0295691 | A1 | 12/2009 | Handa et al. | |
| 2012/0001893 | A1 | 1/2012 | Jeong et al. | |
| 2012/0127956 | A1 | 5/2012 | Wang et al. | |
| 2012/0199854 | A1 * | 8/2012 | Noguchi | H01L 27/3276 257/88 |
| 2012/0248471 | A1 | 10/2012 | Kishi | |
| 2012/0287103 | A1 * | 11/2012 | Wu | G09G 3/3233 345/211 |
| 2014/0071113 | A1 * | 3/2014 | Hong | G09G 3/3208 345/212 |
| 2015/0229117 | A1 * | 8/2015 | Kim | H02H 3/08 345/212 |
| 2015/0364089 | A1 * | 12/2015 | Pyo | G09G 3/3258 345/77 |
| 2016/0063923 | A1 * | 3/2016 | Yang | G09G 3/3258 345/211 |
| 2016/0247453 | A1 | 8/2016 | Hwang | |
| 2016/0358547 | A1 | 12/2016 | Zhu et al. | |

FOREIGN PATENT DOCUMENTS

| | | | |
|---|---|---|---|
| CN | 1744774 | A | 3/2006 |
| CN | 101572055 | A | 11/2009 |
| CN | 101739947 | A | 6/2010 |
| CN | 102314829 | A | 1/2012 |
| CN | 102346999 | A | 2/2012 |
| CN | 103226931 | A | 7/2013 |
| CN | 103325810 | A | 9/2013 |
| CN | 103440843 | A | 12/2013 |
| EP | 1580722 | A2 | 9/2005 |
| EP | 2 854 123 | A1 | 4/2015 |
| JP | 2006317600 | A | 11/2006 |
| JP | 2010-145579 | A | 7/2010 |

* cited by examiner

PIXEL CIRCUIT, PIXEL, AMOLED DISPLAY DEVICE COMPRISING SAME AND DRIVING METHOD THEREOF

TECHNICAL FIELD

The present invention relates to a flat panel display technology, and in particular relates to a pixel circuit, a pixel, and an active matrix organic light-emitting diode (AMOLED) comprising the pixel and a driving method thereof.

BACKGROUND

In recent years, various flat panel display devices with a smaller weight and a smaller size when compared with cathode ray transistors have been developed.

In various flat panel display devices, since active matrix organic light-emitting diode (AMOLED) display devices use a self-illuminating organic light-emitting diode (OLED) to display an image, they typically have properties such as short response time, low power consumption for driving, and a relatively better brightness and color purity. In view of this, organic light-emitting devices have become the focus of the display technology of the next generation.

With regard to a large AMOLED display device, a plurality of pixels located in a cross region of a scan line and a data line is included. Each pixel includes an OELD and a pixel circuit used for driving the OELD. The pixel circuit typically includes switch transistors, driving transistors and storage capacitors.

Since the pixel properties of AMOLEDs are influenced by the difference between driving transistors and the leakage current of the switch transistors, an image displayed by such a plurality of pixels has a relatively poor quality uniformity and consistency.

FIG. 1 is a schematic view of a pixel of an active matrix organic light-emitting diode (AMOLED) display device in the prior art. As shown in FIG. 1, the transistor of the pixel circuit 112 thereof is a PMOS transistor (a MOS transistor which has an n-type substrate and a p-channel and transfers current through hole migration).

The pixel 110 of the AMOLED display device includes: an OLED, and a pixel circuit 112 connected to a data line Dm and a scanning control line Sn1 to control the OLED.

An anode of the OLED is connected to the pixel circuit 112, and a cathode of the OLED is connected to a second power supply ELVSS. The OLED emits light with a corresponding brightness to the current intensity provided by the pixel circuit 112.

When providing a scanning control signal to the scanning control line Sn1, the pixel circuit 112 controls the amount of current provided to the OLED correspondingly to the data signal provided to a data line Dm. To this end, the pixel circuit 112 includes a second transistor T2 (i.e., a driving transistor) connected between a first power supply ELVDD and an anode of the OLED (Organic Light-Emitting Diode), a first transistor T1 (i.e., a switch transistor) connected between a gate of the second transistor T2 and the data line Dm, and a first capacitor C1 connected between the gate of the second transistor T2 and the first power supply ELVDD, wherein the gate of the first transistor T1 is connected to the scanning control line Sn1.

The gate of the first transistor T1 is connected to the scanning control line Sn1, and the source (or the drain) of the first transistor T1 is connected to the data line Dm. The drain (or the source) of the first transistor T1 is connected to one terminal of the first capacitor C1 (the other terminal thereof is connected to the first power supply ELVDD). When a scanning control signal is provided from the scanning control signal line Sn1 to the first transistor T1, the first transistor T1 is turned on, and a data signal provided from the data line Dm is provided to the first capacitor C1. At this time, a voltage corresponding to the data signal is stored in the first capacitor C1.

The gate of the second transistor T2 is connected to one terminal of the first capacitor C1 (the other terminal thereof is connected to the first power supply ELVDD), and the source of the second transistor T2 is connected to the first power supply ELVDD. The drain of the second transistor T2 is connected to the anode of the OLED. The second transistor T2 controls a current flowing to the second power supply ELVSS from the first power supply ELVDD via the OLED, and the current intensity corresponds to the voltage stored in the first capacitor C1.

One terminal of the first capacitor C1 is connected to the gate of the second transistor T2, and the other terminal of the first capacitor C1 is connected to the first power supply ELVDD, and a voltage corresponding to the data signal is charged into the first capacitor C1.

The pixel 110 controls the brightness of the OLED by adjusting the current supplied to the OLED correspondingly to the voltage discharged into the first capacitor C1, and an image with a predetermined brightness is displayed. However, in such a traditional AMOLED display device, due to the change in threshold voltage of the second transistor T2 and the leakage current of the first transistor T1, it is difficult to display an image with a uniform brightness. For example, in different pixels, due to the difference in threshold voltage of the second transistor T2 and the difference in first power supply ELVDD, the current flowing through the OLED is inconsistent when a same gate driving voltage is applied, leading to inconsistency in the brightness of the OLED. Each pixel generates light of different brightness in response to a same data signal, and as a result, the displayed image hardly has a uniform brightness.

SUMMARY

Technical Problems

With regard to this, a main objective of the present invention is to provide a pixel, an active matrix organic light-emitting diode (AMOLED) display device using the pixel and a driving method thereof. By compensating for a difference value between a threshold voltage and a power supply voltage of a transistor, the response characteristics of the AMOLED may be improved to generate light of a same brightness, thereby meeting requirements on image uniformity and consistency of an AMOLED display device.

Solution to the Technical Problems

To achieve the aforementioned object, the technical solutions of the present invention are realized as follow.

A pixel circuit 112 is provided, including a basic circuit 1122. The pixel circuit 112 also includes a power supply circuit 1121 and a compensation circuit 1123; wherein the power supply circuit 1121, the basic circuit 1122 and the compensation circuit 1123 are sequentially connected; and the power supply circuit 1121 is connected to a first power supply ELVDD to supply power to the basic circuit 1121; and the compensation circuit 1123 is connected to a second power supply ELVSS1 and a third power supply ELVSS2 respectively to compensate for a difference of a voltage and current of an OLED.

The power supply circuit 1121 is a second transistor T2; wherein the gate of the second transistor T2 is connected to a scanning control signal line Scan1, the source thereof is connected to the first power supply ELVDD, and the drain thereof is connected to the basic circuit 1122.

The basic circuit 1122 is connected to the compensation circuit 1123 via an OLED and a parasitic capacitor Coled which are connected in parallel.

The basic circuit 1122 includes a first transistor T1, a fifth transistor T5 and a first capacitor C1; wherein and a gate of the first transistor T1 is connected to a second scanning control line Scan2, the source of the first transistor T1 is connected to a data line Dm, and the drain of the first transistor T1 is connected to the gate of the fifth transistor T5; and the first capacitor C1 is connected in parallel between the gate and the source of the fifth transistor T5.

The compensation circuit 1123 includes a parasitic capacitor Coled connected in parallel to the OLED, a third transistor T3 and a fourth transistor T4; and the OLED is, after being connected in parallel to the parasitic capacitor Coled, connected in series between the drain of the fifth transistor T5 of the basic circuit 1122 and the sources of the third transistor T3 and the fourth transistor T4 of the compensation circuit 1123; and the gates of the third transistor T3 and the fourth transistor T4 are connected to an emission control line Eml and an emission control line Em2 respectively; and the drains of the third transistor T3 and the fourth transistor T4 are connected to the second power supply ELVSS1 and the third power supply ELVSS2 respectively.

The present invention also provides a pixel in any aforementioned pixel circuit.

The present invention further provides an AMOLED display device having the pixel.

A pixel driving method is provided, including the following steps:

A: connecting to a power supply circuit (1121) and a basic circuit (1122) via a first power supply ELVDD, and connecting the basic circuit (1122) to a compensation circuit (1123) via an OLED; wherein the compensation circuit (1123) is connected to a second power supply ELVSS1 and a third power supply ELVSS2;

B: supplying power to the basic circuit (1122) by using a second transistor T2 of the power supply circuit (1121), and supplying power to the compensation circuit (1123) by using the second power supply ELVSS1 and the third power supply ELVSS2 respectively; wherein the gate of the second transistor T2 of the power supply circuit (1121) inputs a scanning control signal Scan1; the gate of the first transistor T1 of the basic circuit (1122) inputs a scanning control signal Scan2, and the source the first transistor T1 inputs a data signal Dm; and the gates of the third transistor T3 and the fourth transistor T4 of the compensation circuit (1123) input an emission control signal Em1 and an Emission control signal Em2 respectively, and the sources the third transistor T3 and the fourth transistor T4 are connected to the cathode of the OLED;

C: during a period t1 of a work cycle T of a pixel, providing a scanning control signal, and providing a first power supply voltage ELVDD by the second transistor T2 to initialize a first capacitor C1;

D: during a period t2 in which a scanning control signal Scan2 is provided to the first transistor T1, storing a voltage corresponding to the data signal Vdata provided by the first transistor T1 in the first capacitor C1; and meanwhile, turning on the first transistor T1 in response to the scanning control signal Scan2 of low level, and providing the data signal Vdata, which is provided to the data line Dm, to the gate of the fifth transistor T5 via the first transistor T1; and providing a voltage corresponding to the drain of the second transistor T2 to the anode of the OLED, and charging, by the second power supply voltage ELVSS1, which supplies power to the cathode of the OLED, the first capacitor C1 through the parasitic capacitor Coled of the OLED and the drain of the fifth transistor T5;

E: during a threshold voltage compensation period t3, causing the scanning control signal Em2 to transition to a low level, such that the fourth transistor T4 is turned on in response to the emission control signal Em2; and causing charges at the drain of the second transistor T2 to flow to the third power supply ELVSS2 along a path of the fifth transistor T5 and the anode of the OLED; when the voltage at the drain of the second transistor T2 is a threshold voltage higher than the voltage at the gate of the fifth transistor T5, turning off the fifth transistor T5, and causing charges at the drain of the second transistor T2 to stop flowing;

F: during a light-emitting period t4 of the OLED, causing the scanning control signal Scan1 to transition to a low level; and turning on the second transistor T2 in response to the scanning control signal Scan1, and causing the driving current to flow to the third power supply ELVSS2 along the first power supply via a path of the second transistor T2, the fifth transistor T5, the OLED and the fourth transistor T4.

During the period t1, the voltage of the second power supply ELVSS1 is further provided to the source of the third transistor T3 as a reset voltage by using the third transistor T3, such that the source of the third transistor T3 is constantly reset in each frame.

During a light-emitting period t4 of the OLED, the current holed flowing through the OLED is:

$$Ioled=\tfrac{1}{2}Cox(\mu W/L)(\text{Vdata})^2;$$

where the Cox, μ, W and L represent the channel capacitance per unit area, the channel mobility, the channel width and the channel length of the fifth transistor T5 respectively, and Vdata represents a data voltage.

The current holed flowing through the OLED is approximately expressed as:

$$Ioled=\tfrac{1}{2}*K*[\text{Vdata}]^2$$

where k represents a constant, and Vdata represents a data voltage.

Beneficial effects of the present invention

The present invention provides a pixel circuit, a pixel, and an AMOLED (Active Matrix Organic Light-Emitting Diode) display device and a driving method thereof. The present invention has advantages as follows.

With the pixel of the present invention and the AMOLED display device including the pixel, by compensating for a difference between a threshold voltage and a power supply voltage of a transistor, the response characteristics of the AMOLED may be improved to generate light of a same brightness, thereby meeting requirements on image uniformity and consistency of an AMOLED display device.

DETAILED DESCRIPTION

The pixel circuit, the pixel, and the active matrix organic light-emitting diode (AMOLED) including the pixel and the driving method thereof of the present invention will be described in detail with reference to the accompanying drawings and the embodiments of the present invention.

Herein, when a first element is described to be connected to a second element, the first element can be directly connected to the second element, or can be indirectly connected to the second element via one or more additional elements. Further, for the purpose of clarity, some elements that are not necessary for fully understanding the present invention are omitted.

Figure 1:
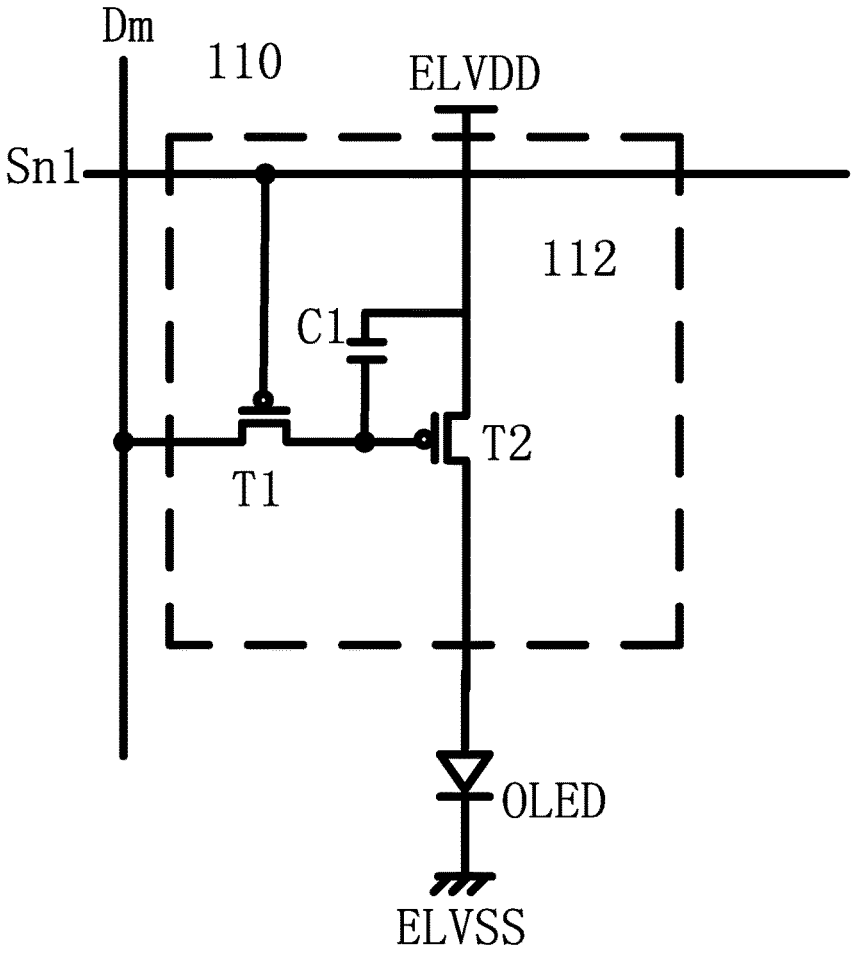
FIG. 1 is a schematic view of a pixel circuit of an active matrix organic light-emitting diode (AMOLED) in the prior art.
Figure 2:
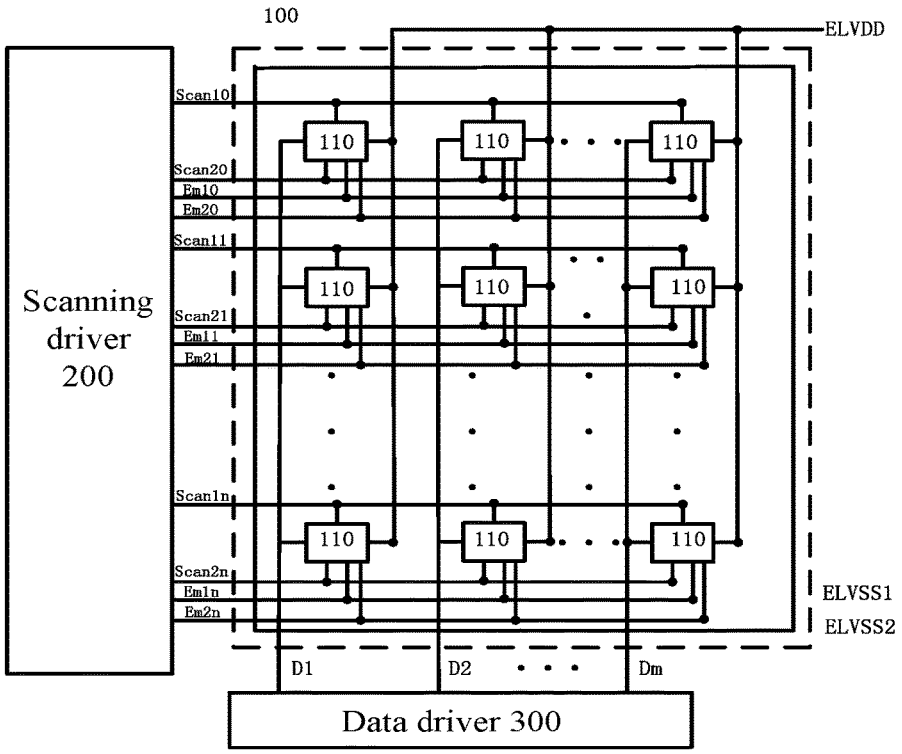
FIG. 2 is a functional block diagram of an active matrix organic light-emitting diode (AMOLED) including a pixel according to the present invention.

FIG. 2 is a functional block diagram of an active matrix organic light-emitting diode (AMOLED) including a pixel according to the present invention. As shown in FIG. 2, the AMOLED display device mainly includes a display unit 100, a scanning driver 200 and a data driver 300.

Figure 3:
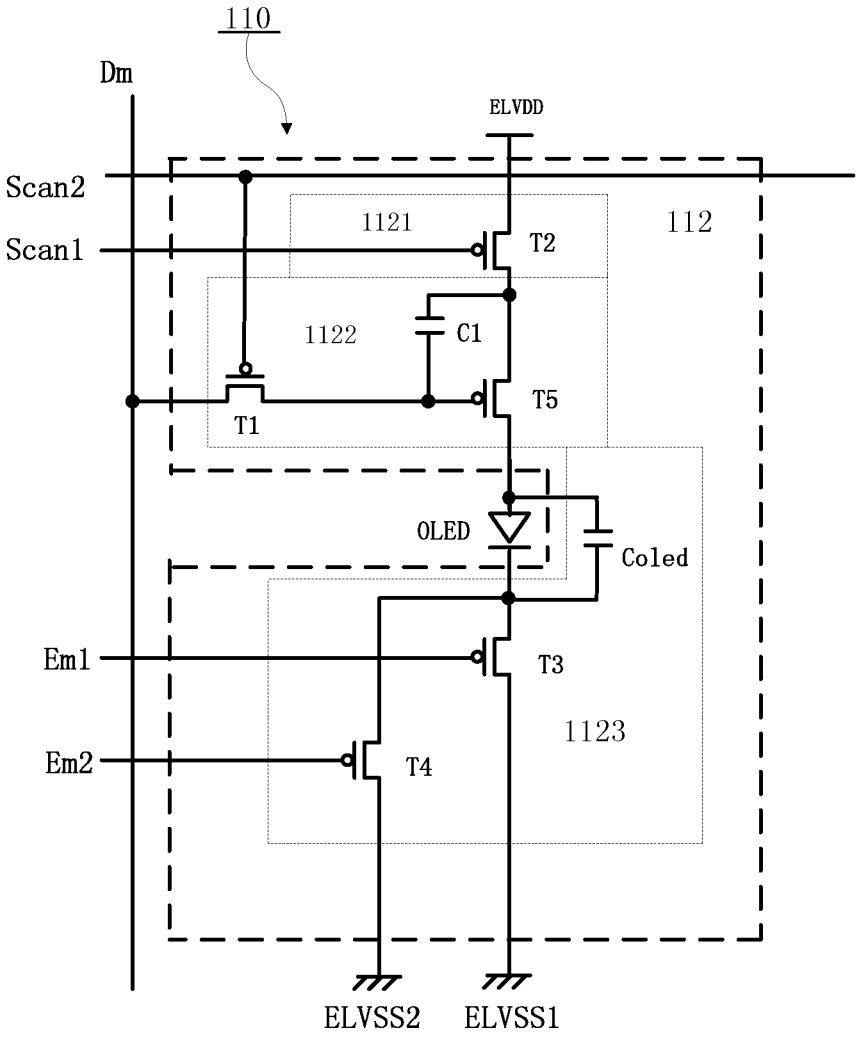
FIG. 3 is a schematic architecture diagram of the pixel of FIG. 2.

The display unit 100 includes a plurality of pixels 110 (as shown in FIG. 3), wherein the plurality of pixels 110 are arranged in a matrix in cross regions of a scanning control line Scan1n, a scanning control line Scan2n, an emission control line Em1n, an emission control line Em2n, and a data line D1 to a data line Dm, where n is the number of a row in which a pixel is located.

Each pixel 110 is connected to a scanning control line (for example, Scan1n, Scan2n), and an emission control line (for example, Em1n, Em2n) and a data line respectively. The data line is connected on a column basis to the pixel 110 in each column of pixels respectively. For example, a pixel 110 in the $i^{th}$ row and the $j^{th}$ column is connected to scanning control lines Scan1I and Scan2I in the $i^{th}$ row, emission control lines Em1I and Em2I in the $i^{th}$ row and a data line Dj in the $j^{th}$ column.

The display unit 100 is supplied with power by an external power supply, for example, a first power supply ELVDD, a second power supply ELVSS1 and a third power supply ELVSS2. The first power supply ELVDD and the third power supply ELVSS2 are used as a voltage source of high level and a voltage source of low level respectively. The first power supply ELVDD and the third power supply ELVSS2 are used as driving power supplies for the pixel 110. The second power supply ELVSS1 is configured to compensate for the change in driving current of an organic light-emitting diode caused by fluctuation in threshold voltage of the fifth transistor T5 (referring to FIG. 3)

The scanning driver 200 generates a scanning control signal and an emission control signal, which are both used for the pixel 110. The scanning control signal generated by the scanning controller 200 is provided to the pixel 110 sequentially from the scanning control line Scan1I to the scanning control line Scan1n respectively; and the emission control signal generated by the scanning controller 200 is provided to the pixel 110 sequentially from the emission control line Em1I to the emission control line Em1n respectively.

The data driver 300 generates data for the pixel 110 and a data signal corresponding to the data control signal. The data signal generated by the data driver 300 and the scanning signal are synchronously provided to the pixel 110 via the data line D1 to the data line Dm.

FIG. 3 is a schematic architecture diagram of the pixel of FIG. 2. The pixel as shown in FIG. 3 can be applied to the AMOLED display device as shown in FIG. 2. For ease of description, in FIG. 3, the pixel 110 in the $n^{th}$ row and the $m^{th}$ column is exemplified for description, and a data line Dm is included.

As shown in FIG. 3, the pixel 110 includes a pixel circuit 112 and an OLED. The pixel circuit 112 is connected between a first power supply ELVDD and a third power supply ELVSS2 for providing a driving current to the OLED (Organic Light-Emitting Diode).

The pixel circuit 112 mainly includes a power supply circuit 1121, a basic circuit 1122 and a compensation circuit 1123, which are sequentially connected.

The power supply circuit 1121 includes a second transistor T2. The gate of the second transistor T2 is connected to a first scanning control line Scan1, the source (or the drain) thereof is connected to the first power supply ELVDD, and the drain (or the source) thereof is connected to the source (or the drain) of the fifth transistor T5 in the basic circuit 1122.

The basic circuit 1122, i.e., a 2T1C circuit, is an existing common pixel circuit. The basic circuit 1122 includes a first transistor T1, a fifth transistor T5, a first capacitor C1.The gate of the first transistor T1 is connected to a second scanning control line Scan2, and the source (or the drain) of the first transistor T1 is connected the data line Dm, and the drain (or the source) thereof is connected to the gate of the fifth transistor T5. The first capacitor C1 is connected in parallel between the gate of the fifth transistor T5 and the source (or the drain) of the power supply circuit 1121. In other words, the basic circuit 1122 is connected to the drain (or the gate) of the second transistor T2 of the power supply circuit 1121 through the source (or the drain) of the fifth transistor T5.

The basic circuit 1122 is connected to the anode of the OLED in the pixel 110 through the drain (or the source) of the fifth transistor T5, and the cathode of the OLED is connected to the sources (or the drains) of the third transistor T3 and the fourth transistor T4 of the compensation circuit 1123. A parasitic capacitor Coled is connected in parallel between the anode and the cathode of the OLED, to form the compensation circuit 1123 with the third transistor T3 and the fourth transistor T4.

In the compensation circuit 1123. the drains (or the sources) of the third transistor T3 and the fourth transistor T4 are connected to the second power supply ELVS S1 and the third power supply ELVSS2 respectively. The gate of the third transistor T3 is connected to the emission control line Em1, and the gate of the fourth transistor T4 is connected to the emission control line Em2. The sources (or the drains) of the third transistor T3 and the fourth transistor T4 are of a same potential.

The first transistor, the second transistor, the third transistor, the fourth transistor and the fifth transistor as described above are all field effect transistors, and the sources and the drains thereof are the same.

When the pixel circuit 112 of the present invention works:

with regard to the first transistor T1, during a period t2 in which a scanning control signal is provided to the scanning control line Scan2, the first transistor T1 provides a data voltage Vdata to the gate of the fifth transistor.

The second transistor T2 is connected between the first power supply ELVDD and the source (or the drain) of the fifth transistor T5, and the gate of the second transistor T2 provides, by being connected to the scanning control line Scan1, the scanning control signal to the scanning control line Scan1 during the period t2, and at this time, the second transistor T2 in the power supply circuit 1121 is turned on, such that the first power supply ELVDD and the pixel 110 are turned on.

The third transistor T3 is connected between the cathode of the OLED and the second power supply ELVSS1, and the gate of the third transistor T3 is connected to the emission control line Em1. During a period T3 in which the scanning control signal is provided to the emission control line Em1, the third transistor T3 is turned on, such that the OLED and the second power supply voltage ELVSS1 are turned on. In this way, the pixel 110 is controlled such that the amplitude of the cathode driving voltage of the OLED is a voltage of the second power supply ELVSS1 during the initialization period t1 and the data voltage write period t2.

The fourth transistor T4 is connected between the cathode of the OLED and the third power supply ELVSS2, and the gate of the fourth transistor T4 is connected to the emission control line Em2. During a period t4in which the scanning control signal is provided to the emission control line Em2, the fourth transistor T4 is turned on, such that the OLED and the third power supply voltage ELVSS2 are turned on. In this way, the pixel 110 is controlled such that the amplitude of the cathode driving voltage of the OLED is a voltage of the third power supply ELVSS2 during the threshold voltage compensation period t3 and the light-emitting period t4.

The fifth transistor T5 is serially connected between the second transistor T2 and the anode of the OLED, and the gate of the fifth transistor T5 is connected to the drain (or the source) of the first transistor T1. When the scanning control signal Scan2 provided from the scanning control line transitions to a low level, the first transistor T1 is turned on, and the data signal is sent to the gate of the fifth transistor T5 through the first transistor T1.

The first capacitor C1 is connected between the drain (or the source) of the second transistor T2 and the gate of the fifth transistor T5. During the period t1 in which the scanning control signal is provided to the scanning control line Scan1, a first power supply voltage ELVDD is provided through the second transistor T2 to initialize the first capacitor C1. Then, during the period t2 in which the scanning control signal is provided to the scanning control line Scan2, a voltage corresponding to the data signal provided through the first transistor T1 is stored in the first capacitor C1.

The OLED is serially connected between the drain (or the source) of the fifth transistor T5 and the source (or the drain) of the third transistor T3. During the light-emitting period t4 of the OLED, the OLED will emit light with a corresponding intensity to the intensity of the driving current provided through the first power supply ELVDD, the fifth transistor T5, the second transistor T2 and the fourth transistor T4.

In pixel 110, due to inconsistency of the threshold voltage of a driving transistor (for example, the fifth transistor T5), the current flowing through the OLED is also inconsistent. As a result, the consistency of brightness of the pixel 110 becomes poor, and the image non-uniformity is finally caused. However, by the addition of the fourth transistor T4 and the third transistor T3, the change in threshold voltage of a driving transistor (for example, the fifth transistor T5) is compensated for during the initialization period t1 of each frame, so that the product defect of image non-uniformity resulted from the aforementioned poor uniformity of brightness of the pixel 110 may be avoided.

Figure 4:
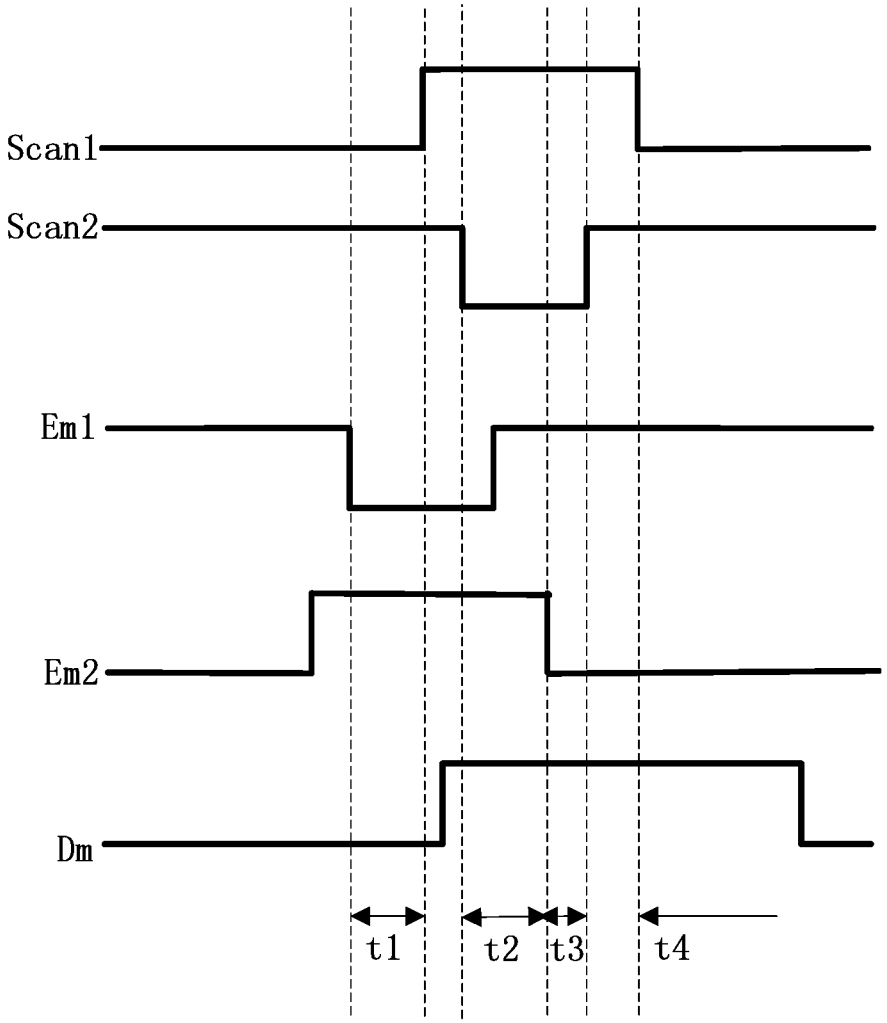
FIG. 4 is a waveform diagram of a driving signal for driving the pixel of FIG. 3.

FIG. 4 is a waveform diagram of a driving signal for driving the pixel of FIG. 3. For ease of description, FIG. 4 shows a waveform of a driving signal provided by the pixel of FIG. 3 during a frame signal period4. The driving process of the pixel will be described with reference to FIG. 3.

The scanning control signal Scan1 configured to control the second transistor T2 to control the ON-connection between the second transistor T2 and the first power supply ELVDD.

The scanning control signal is configured to control the first transistor T1 to write a data level.

The emission control line Em1 is configured to control the third transistor T3 to control the ON-connection between the third transistor T3 and the second power supply ELVSS1.

The emission control line Em2 is configured to control the fourth transistor T4 to control the ON-connection between the fourth transistor T4 and the third power supply ELVSS2.

As shown in FIG. 4, during a period set to perform initialization, i.e., period t1, first, a scanning control signal Scan1 of low level is provided to the pixel 110. Thus, the second transistor T2 is turned on through the scanning control signal Scan1 of low level, such that the voltage of the first power supply ELVDD is provided to the source (or the drain) of the fifth transistor T5. An emission control signal Em1 of low level is provided to the pixel 110. Thus, the third transistor T3 is turned on through the emission control signal Em1 of low level, such that the voltage of the second power supply ELVSS1 is provided to the source (or the drain) of the third transistor T3.

With reference to FIG. 3, during the period t1, the voltage of the second power supply ELVSS1 may be also provided to the source (or the drain) of the third transistor T3 as a reset voltage by the third transistor T3, so as to constantly reset the source (or the drain) of the third transistor T3 in each frame.

Then, during the period t2 set to perform data voltage writing (i.e., a stage for writing a data voltage), a scanning control signal Scan2 of low level is provided to the pixel 110. Then, the first transistor T1 is turned on in response to the scanning control signal Scan2 of low level. Thus, a data signal Vdata provided to the data line Dm is provided to the gate of the fifth transistor T5 via the first transistor T1. At this time, since the fifth transistor T5 is in an ON state, a voltage corresponding to the drain (or the source) of the second transistor T2 is provided to the anode of the OLED. However, the second power supply voltage ELVSS1 provided to the cathode of the OLED supplies power to the first capacitor C1 through the parasitic capacitor Coled of the OLED and the drain (or the source) of the fifth transistor T5.

Then, during the period t3 set to perform threshold voltage compensation (i.e., threshold compensation), the emission control signal Em2 transitions to a low level. Then, the fourth transistor T4 is turned on in response to the emission control signal Em2,and charges at the drain (or the source)of the second transistor T2 flow to the third power supply ELVSS2 along a path of the fifth transistor T5 and the anode of the OLED; when the voltage at the drain (or the source) of the second transistor T2 is one threshold voltage higher than the voltage at the gate of the fifth transistor T5 (i.e., threshold voltage of the fifth transistor T5), the fifth transistor T5 is turned off, and charges at the drain (or the source) of the second transistor T2 stop flowing.

Herein, a voltage of the fifth transistor T5 corresponding to the threshold voltage provided to the fifth transistor T5 is stored in the first capacitor C1, such that the threshold voltage of the fifth transistor T5 is compensated for during the period T3.

At last, during the period t4 set to emit light (i.e., the light-emitting stage), the scanning control signal Scan1 transitions to a low level. Then, the second transistor T2 is turned on in response to the scanning control signal Scan1. Thus, the driving current flows to the third power supply ELVSS2 along the first power supply ELVDD via a path of the second transistor T2, the fifth transistor T5, the OLED and the fourth transistor T4. The current bled flowing through the organic light-emitting diode (OLED) is:

$$Ioled=\tfrac{1}{2}Cox(\mu W/L)(\text{Vdata})\hat{}2;$$

where Cox, μ, W and L represent the channel capacitance per unit area, the channel mobility, the channel width and the channel length of the fifth transistor T5 respectively, and Vdata represent a data voltage.

The current flowing through the OLED can be approximately expressed as:

$$\begin{aligned} Ioled &= 1/2*K*[Vsg-|Vth|]\hat{}2 \\ &= 1/2*K*[Vdd-(Vdd-Vc1)-|Vth|\hat{}2 \\ &= 1/2*K*[|Vth|+(1-N)/N*Vdata-|Vth|]\hat{}2 \\ &= 1/2*K*[(1-N)/N*Vdata]\hat{}2 \\ &= 1/2*K*[Vdata]\hat{}2 \end{aligned},$$

where k is Cox* μ *W*L, which is a constant; and Vsg is the voltage difference between a source and a gate; Vth represents a threshold voltage; Vdd represents the first power supply voltage ELVDD; Vc1 represents a voltage stored in the first capacitor C1; Vdata represents a data voltage; and N is a natural number greater than 1.

Described above are merely preferred embodiments of the present invention, but are not intended to limit the protection scope of the present invention.

What is claimed is:

1. A pixel circuit, comprising a basic circuit, a power supply circuit, and a compensation circuit; wherein the power supply circuit, the basic circuit and the compensation circuit are sequentially connected; the power supply circuit is connected to a first power supply ELVDD to supply power to the basic circuit; and the compensation circuit is connected to a second power supply ELVSS1 and a third power supply ELVSS2 to compensate for a change in current of an organic light emitting diode (OLED) caused by a change in threshold voltage of a transistor;

wherein the basic circuit comprises a first transistor, a fifth transistor and a first capacitor; wherein a gate of the first transistor is connected to a second scanning control line, a source of the first transistor is connected to a data line Dm, and a drain of the first transistor is connected to a gate of the fifth transistor; and the first capacitor is connected in parallel between the gate of the fifth transistor and a source of the fifth transistor; and wherein the compensation circuit comprises a parasitic capacitor connected in parallel to the OLED, a third transistor and a fourth transistor; the OLED is, after being connected in parallel to the parasitic capacitor, connected in series between a drain of the fifth transistor of the basic circuit and sources of the third transistor and the fourth transistor of the compensation circuit; and gates of the third transistor and the fourth transistor are connected to a first emission control line and a second emission control line respectively; and drains of the third transistor and the fourth transistor are connected to the second power supply and the third power supply respectively.

2. The pixel circuit according to claim 1, wherein: the power supply circuit is a second transistor; a gate of the second transistor is connected to a scanning control signal line Scanl; a source of the second transistor is connected to the first power supply ELVDD; and a drain of the second transistor is connected to the basic circuit.

3. A pixel comprising a pixel circuit as defined in claim 2.

4. The pixel circuit according to claim 1, wherein the basic circuit is connected to the compensation circuit via the OLED and a parasitic capacitor which are connected in parallel.

5. A pixel comprising a pixel circuit as defined in claim 4.

6. A pixel comprising a pixel circuit as defined in claim 1.

7. An AMOLED display device comprising a pixel as defined in claim 6.

8. A pixel driving method for driving the pixel circuit of claim 1, comprising the following steps:

A: connecting the basic circuit to the first power supply via the power supply circuit, and connecting the basic circuit to the compensation circuit via the OLED and the parasitic capacitor; wherein the compensation circuit is connected to the second power supply and the third power supply;

B: supplying power to the basic circuit by using a second transistor of the power supply circuit, and supplying power to the compensation circuit by using the second power supply and the third power supply; wherein a gate of the second transistor of the power supply circuit inputs a first scanning control signal; a gate of the first transistor of the basic circuit inputs a second scanning control signal; the source of the first transistor inputs a data signal Vdata from the data line Dm; the gates of the third transistor and the fourth transistor of the compensation circuit input a first emission control signal and a second emission control signal respectively; and the sources of the third transistor and the fourth transistor are connected to a cathode of the OLED;

C: during a first period of a work cycle of a pixel, providing a scanning control signal, and providing a first power supply voltage by the second transistor to initialize the first capacitor, the first capacitor connected between a drain of the second transistor and the gate of the fifth transistor;

D: during a second period in which the second scanning control signal is provided to the first transistor, storing a voltage corresponding to the data signal Vdata provided by the first transistor in the first capacitor; and meanwhile, turning on the first transistor in response to the second scanning control signal of low level, and providing the data signal Vdata, which is provided to the data line Dm, to the gate of the fifth transistor via the first transistor; and providing a voltage corresponding to the drain of the second transistor to an anode of the OLED, and charging, by a second power supply voltage, which supplies power to the cathode of the OLED, the first capacitor through the parasitic capacitor of the OLED and the drain of the fifth transistor;

E: during a threshold voltage compensation period, causing the second emission control signal to transition to a low level, such that the fourth transistor is turned on in response to the second emission control signal; and causing charges at the drain of the second transistor to flow to the third power supply along a path of the fifth transistor and the anode of the OLED; when the voltage at the drain of the second transistor is a threshold voltage higher than the voltage at the gate of the fifth transistor, turning off the fifth transistor, and causing charges at the drain of the second transistor to stop flowing;

F: during a light-emitting period of the OLED, causing the first scanning control signal to transition to a low level; and turning on the second transistor in response to the first scanning control signal, and causing a driving current to flow to the third power supply along the first power supply via a path of the second transistor, the fifth transistor, the OLED and the fourth transistor.

9. The pixel driving method according to claim 8, wherein during the period, the voltage of the second power supply is further provided to the source of the third transistor as a reset voltage by using the third transistor, such that the source of the third transistor is constantly reset in each frame.

10. The pixel driving method according to claim 8, wherein during a light-emitting period t4 of the OLED, the current Ioled flowing through the OLED is:

$$Ioled=\frac{1}{2}Cox(\mu W/L)(\text{Vdata})^2;$$

where Cox, μ, W and L represent the channel capacitance per unit area, the channel mobility, the channel width and the channel length of the fifth transistor T5 respectively, and Vdata represents a data voltage.

11. The pixel driving method according to claim 10, wherein the current Ioled flowing through the OLED is approximately expressed as:

$$Ioled=\frac{1}{2}*K*[\text{Vdata}]^2$$

where k represents a constant, and Vdata represents a data voltage.

* * * * *